US011492847B2

(12) United States Patent
Yoo

(10) Patent No.: US 11,492,847 B2
(45) Date of Patent: Nov. 8, 2022

(54) LADDER

(71) Applicant: Thomas Yoo, Garden Grove, CA (US)

(72) Inventor: Thomas Yoo, Garden Grove, CA (US)

( * ) Notice: Subject to any disclaimer, the term of this patent is extended or adjusted under 35 U.S.C. 154(b) by 376 days.

(21) Appl. No.: 16/799,483

(22) Filed: Feb. 24, 2020

(65) Prior Publication Data

US 2021/0262287 A1 Aug. 26, 2021

(51) Int. Cl.
*E06C 1/18* (2006.01)
*E06C 7/08* (2006.01)

(52) U.S. Cl.
CPC . *E06C 1/18* (2013.01); *E06C 7/08* (2013.01)

(58) Field of Classification Search
CPC .. B25H 1/04; E04G 1/34; E06C 1/393; E06C 1/18; E06C 1/32; E06C 7/08
USPC ..... 182/152, 156
See application file for complete search history.

(56) References Cited

U.S. PATENT DOCUMENTS

| | | | | |
|---|---|---|---|---|
| 763,209 | A * | 6/1904 | Schwalbe | E06C 1/387 182/175 |
| 826,582 | A | 7/1906 | Laird | |
| 864,898 | A | 9/1907 | Koues | |
| 964,324 | A * | 7/1910 | Spaulding | E06C 1/32 182/123 |
| 1,198,739 | A * | 9/1916 | Marciniak et al. | E06C 1/005 182/29 |
| 1,218,021 | A | 3/1917 | Walther | |
| D158,136 | S | 4/1950 | Simon | |
| 2,592,912 | A | 4/1952 | Knipper | |
| 4,004,652 | A | 1/1977 | Laboy-Alvarado | |
| 4,053,028 | A | 10/1977 | Ioix | |
| 4,235,449 | A | 11/1980 | Tarran | |
| 4,284,286 | A | 8/1981 | Lewallen | |
| 4,341,164 | A | 7/1982 | Johnson | |
| 4,448,282 | A | 5/1984 | Giezendanner | |
| 4,471,969 | A | 9/1984 | Zabala | |
| 4,557,350 | A | 12/1985 | Wang | |
| 4,574,918 | A | 3/1986 | Marques | |
| 4,699,246 | A | 10/1987 | Wang | |
| 4,800,988 | A | 1/1989 | Dunmore | |

(Continued)

FOREIGN PATENT DOCUMENTS

FR 2618845 A1 * 7/1987

*Primary Examiner* — Jose V Chen
(74) *Attorney, Agent, or Firm* — John K. Park; Park Law Firm

(57) ABSTRACT

A collapsible ladder that collapse not only the rails but also the steps, as well as the top caps, so that the ladder may be erected and then collapsed flat, saving storage space. The ladder has a pair of right siderails rotatably connected to a pair of left siderails. The right top cap and the right steps are rotatably attached in between the pair of right siderails. The right top cap and the right steps are also rotatably attached in between the pair of right linking rails. Likewise, the ladder also has a pair of left siderails rotatably connected to a pair of left siderails. The left top cap and the left steps are rotatably attached in between the pair of left siderails. The left top cap and the left steps are also rotatably attached in between the pair of left linking rails. Because the siderails, the steps, the linking rails are all rotatably attached to form the ladder, the ladder may be open and erected and also may be folded and collapsed to save space for storage and for carrying.

20 Claims, 9 Drawing Sheets

(56) References Cited

U.S. PATENT DOCUMENTS

| | | | | |
|---|---|---|---|---|
| 4,834,216 | A * | 5/1989 | Wallick, Jr. | E06C 7/08 182/180.1 |
| 5,052,515 | A | 10/1991 | Nowlan | |
| 5,368,126 | A | 11/1994 | Woodward | |
| 5,720,362 | A | 2/1998 | Denkins | |
| 5,722,507 | A | 3/1998 | Kain | |
| 5,746,288 | A | 5/1998 | O'Neal | |
| 6,000,497 | A | 12/1999 | Kain | |
| 6,173,811 | B1 | 1/2001 | Tornabene et al. | |
| 6,651,774 | B2 | 11/2003 | Yoo | |
| 6,837,642 | B1 | 1/2005 | Lin | |
| D523,156 | S | 6/2006 | Skaggs | |
| D536,799 | S | 2/2007 | Freitas | |
| 7,690,316 | B2 | 4/2010 | Yoo | |
| 7,931,123 | B2 * | 4/2011 | Moldthan | E06C 1/387 182/161 |
| 8,162,280 | B2 | 4/2012 | Yu | |
| D715,458 | S | 10/2014 | Collins | |
| D810,321 | S | 2/2018 | Heffernan | |
| 10,012,000 | B2 | 7/2018 | Yoo | |
| D848,029 | S | 5/2019 | Green | |
| 2004/0238278 | A1 | 12/2004 | Gibson et al. | |
| 2004/0238280 | A1 | 12/2004 | Gibson et al. | |
| 2005/0274571 | A1 | 12/2005 | Simpson et al. | |
| 2008/0109994 | A1 * | 5/2008 | Liao | E06C 1/32 16/319 |
| 2012/0085268 | A1 * | 4/2012 | Straface | B25H 1/16 108/25 |
| 2015/0027810 | A1 * | 1/2015 | Yoo | E06C 1/393 182/27 |
| 2015/0047927 | A1 | 2/2015 | Nodarse | |
| 2017/0254145 | A1 | 9/2017 | Ballard | |
| 2019/0383100 | A1 | 12/2019 | Yoo | |
| 2019/0390518 | A1 | 12/2019 | Yoo | |
| 2020/0141184 | A1 * | 5/2020 | Liu | E06C 1/393 |
| 2020/0325726 | A1 * | 10/2020 | Yoo | E06C 1/393 |
| 2020/0391372 | A1 * | 12/2020 | Strempke | B25H 3/006 |
| 2022/0025704 | A1 * | 1/2022 | Bibler | E06C 1/383 |
| 2022/0098928 | A1 * | 3/2022 | Zaifman | A47C 12/02 |

* cited by examiner

LADDER

BACKGROUND

A need for a ladder that may be folded with collapsible steps to save storage space has been present for a long time to assist the user in safely using ladders. This invention is directed to solve these problems and satisfy the long-felt need.

SUMMARY

A collapsible ladder that collapse not only the rails but also the steps, as well as the top caps, is presented herein. The ladder may be erected and then collapsed flat, saving storage space.

The ladder has a pair of right siderails rotatably connected to a pair of left siderails. The ladder also has a plurality of right steps. Each of the right steps has a right rail-joining points so that each right rail-joining point is rotatably attached to a right linking rail. Likewise, the ladder also has a plurality of left steps. Each of the left steps has a left rail-joining point so that each left rail-joining point is rotatably attached to a left linking rail.

The ladder also has a right top-cap and a left top-cap. The right linking rail is rotatably connected to the right top-cap and the left linking rail is rotatably connected to a left top-cap.

Each right step has a right linking-joining point so that each right step is rotatably attached to the right linking rail at the corresponding right linking-joining point and each left step has a left linking-joining point wherein each left step is rotatably attached to the left linking rail at the corresponding left linking-joining point.

The right linking rail of the ladder is also connected to the right top cap and the left linking rail of the ladder is also connected to the left top cap. The right top cap and the left top cap are used to support weight of a user or an item place on the right or the left top cap, or both, and the right top cap and the left top cap are rotatably connected to each other.

The ladder may also have a right spreader and a left spreader. Each of the right spreader and the left spreader has two ends. One end of the right spreader is rotatably attached to the right siderail and the other end of the right spreader is attached to the left spreader. Similarly, one end of the left spreader is rotatably attached to the left siderail and the other end of the left spreader is attached to the right spreader To better secure the ladder when the ladder is in erected open position, the ladder also has a right support bar and a left support bar. Each of the right support bar and the left support bar has two ends. One end of the right support bar is rotatably attached to the right siderail and the other end is attached to the right top cap. Likewise, one end of the left support bar is rotatably attached to the left siderail and the other end is attached to the left top cap.

In order to better rotatably open the pair of right siderails and the pair of left siderails, the latter may have a hinge plate rotatably connecting one of the pair of right siderails and one of the pair of left siderails.

The ladder may be better securely held open and erected by having a spreader lock. The spreader lock may be placed on either of the right spreader or the left spreader, so that the spreader lock prevents the right spreader and the left spreader from rotating beyond the horizontal position in one direction when the right spreader and the left spreader are horizontally aligned.

The right top cap may also have a right gear and the left top cap may have a left gear. The right gear has protrusions and indentations forming gear teeth and the left gear has protrusions and indentations forming gear teeth, so that the right gear and the left gear engage each other to rotate the right top cap and the left top cap at the same rate of rotation. The protrusions and the indentations of the right gear and the left gear do not have to be completely surrounding the outer rims of the right gear and the left gear so that the rotation of the right gear and the left gear may be prevented at one or more predetermined positions.

To better facilitate the folding the ladder, at least one of the siderails has a groove so that the support bar and the spreader joined together may slidably move along the groove. The sliding action may be accomplished by the right support bar and the right spreader joined together at a right slider point that is slidably attached to the right siderail so that the right slider point may slide along a right groove. Moreover, the sliding action may be accomplished by the left support bar and the left spreader joined together at a left slider point that is slidably attached to the left siderail so that the left slider point may slide along a left groove. It is preferable that a groove is on each of the pair of the right siderails and a groove is on each of the pair of the left siderails, so that each groove slidably receives a respective slider point formed by a support bar and a spreader. Also, it is preferred that the grooves are inside surface of the right and the left siderails as shown in the Figs.

One or more of the right slider point and the left slider point may be a part of a larger slider block. For example, the right slider point may be a part of a right slider block that is slidably attached to the right siderail so that the right slider block may slide along the right groove. Likewise, the left slider point is a part of a left slider block that is slidably attached to the left siderail so that the left slider block may slide along the left groove. The use of a slider block prevents unnecessary wear and tear on the slider points and also facilitate more secure and tight fitting slide action along the groove.

In addition to the use of a spreader lock, to better prevent an accidental collapsing or opening of the ladder, the ladder may also have a right spreader block mounted on at least one of the right siderails. The right spreader block has a right spreader-block indentation that receives a right-end portion of the right spreader. Similarly, the ladder may also have a left spreader block mounted on at least one of the left siderails. The left spreader block has a left spreader-block indentation that receives a left-end portion of the left spreader The ladder may have an anti-slip foot at each floor contacting end of the each of the right siderails and the left siderails.

As the Figs show the ladder has a front side and a rear side. The pair of right siderails are rotatably connected to a pair of left siderails. One right siderail is rotatably connected to the one left siderail on the front-side of the ladder and the other right siderail is rotatably connected to the other left siderail on the rear-side of the ladder.

Each of the right siderails has a plurality of right step-joining points and each of left siderails have a plurality of left step-joining points. In between each of the right siderails, the right siderails accept the plurality of right steps by rotatably accepting the right step-joining point at its respective right rail-joining point. Likewise, in between each of the left siderails, the left siderails accept the plurality of left steps by rotatably accepting the left step-joining point at its respective left rail-joining point.

It is preferred to have a pair of right linking rails rotatably connected to a right top-cap and a pair of left linking rails rotatably connected to a left top-cap. The right top-cap is mounted in between the pair of right linking rails and the left top-cap is mounted in between the pair of left linking rails.

The ladder may have a pair of right spreaders, one right spreader on the front-side and one right spreader on the rear-side of the ladder. Each of the right spreader has two ends, with one end rotatably attached to one of the right siderails and the other end attached to one of a pair of left spreaders. Likewise, the ladder may have a pair of left spreaders, one left spreader on the front-side and one left spreader on the rear-side of the ladder. Each of the left spreaders has two ends wherein one end is rotatably attached to one of the left siderails and the other end is attached to one of a pair of right spreaders.

The pair of right spreaders may be rotatably attached to a pair of right support bars and the pair of left spreaders may be rotatably attached to a pair of left support bars. Each of the right support bars has two ends and each of the left support bars has two ends. One end of the right support bar is rotatably attached to one of the right siderails and the other end is attached to the right top cap, and one end of the left support bar is rotatably attached to one of the left siderails and the other end is attached to the left top cap.

The right spreader and the left spreader on the front-side has a spreader lock that prevents the connected right spreader and the connected left spreader to rotate further in one direction when the connected right spreader and the connected left spreader are horizontally aligned. The right spreader and the left spreader on the rear-side also has a spreader lock that prevents the connected right spreader and the connected left spreader to rotate further in one direction when the connected right spreader and the connected left spreader are horizontally aligned.

The right top cap has a right gear and the left top cap has a left gear. The gear on the right top cap engages the gear on the left top cap. It is possible to have more than one right gear and one left gear, optionally one set on the front-side and the other set on the rear-side. Because the gears on the right top cap and on the left top cap engage one another, the right top cap and the left top cap rotate at the same rate of rotation.

Thus, from the open position of the ladder, once the joint between the right spreader and the left spreader is pushed upward, the right top cap and the left top cap are rotated downward hinged by the gears, allowing the right and left slide blocks to move along the grooves of the right and left siderails, collapsing the ladder to save space for storage or hanging.

The advantages of the embodiments of the ladder described herein, including but not limited, are: (1) helps the user of the ladder to more securely place items on the right top cap and the left top cap, (2) the entire ladder, including the top caps and the steps are neatly folded (collapsed) for space saving, storage and carrying.

Although the present invention is briefly summarized, a better understanding of the invention can be obtained by the following drawings, detailed description and appended claims.

DESCRIPTION OF THE DRAWINGS

These and other features, aspects and advantages of the present invention will become better understood with reference to the accompanying drawings, wherein.

DETAILED DESCRIPTION

Referring to the figures, various embodiments of the invention are described.

Figure 1:
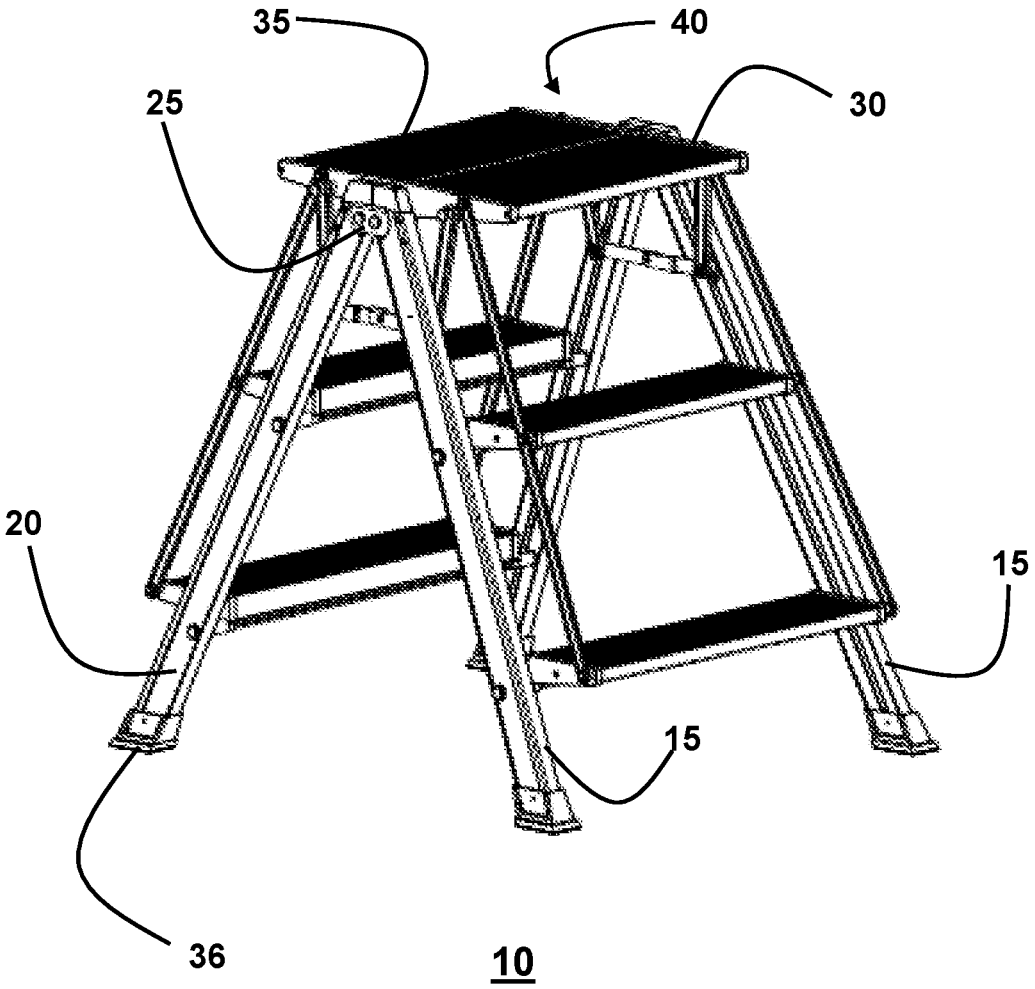
FIG. 1 is an isometric view of an embodiment of the ladder in open position.

FIG. 1 shows an embodiment of a ladder 10 described herein. A pair of right siderails 15 are rotatably attached to a pair of left siderails 20. A hinge plate 25 may be used to rotatably connect a right siderail 15 and a left siderail 20 as shown. A single hinge plate 25 use may be preferable as the other side may have a different configuration, such as use of gears directly connected to one of the right siderails 15 and one of the left siderails 20.

A right top cap 30 and a left top cap 35 are rotatably attached to the hinge plate 25. In a fully opened position of the ladder 10 as shown has the right top cap 30 and the left top cap 35 forming a flat platform 40. On the flat platform 40, an item may be securely placed on it and the flat platform 40 may be designed to withstand a person standing on it. The surface of either or both right top cap 30 and the left top cap 35 may have non-slip cover or coating or knurled to prevent a person from slipping. The ladder may also have an anti-slip foot 36 at each floor contacting end of the each of the right siderails and the left siderails.

Figure 2:
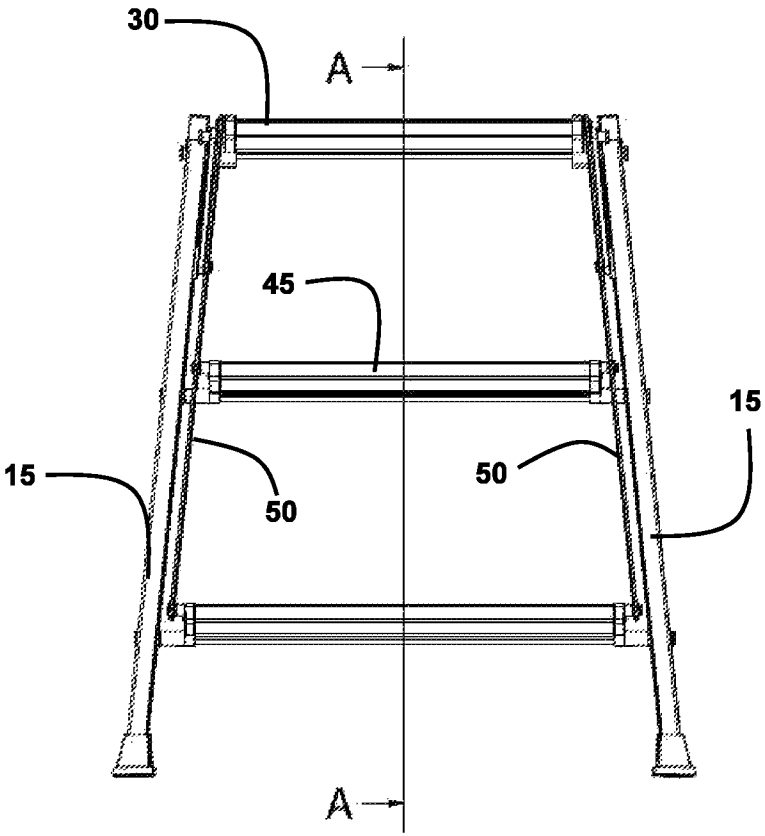
FIG. 2 is the ladder shown from a side.

FIG. 2 is the ladder 10 shown from the right side of the ladder 10. The ladder 10 shows the right top cap 30 rotatably attached in between a pair of the right siderails 15. Also, the ladder shows a plurality of right steps 45 rotatably attached in between a pair of the right siderails 15. Also shown are a pair of right linking rails 50 rotatably connected to the right top cap 30 and the plurality of the right steps 45. Because FIG. 2 shows a view from the right side, a pair of left siderails 20, a pair of left linking rails 55, the left top cap 35 and a plurality of left steps 60 are not shown due to their position directly behind the corresponding right side. Each of these hidden items are shown in later Figs.

Figure 3:
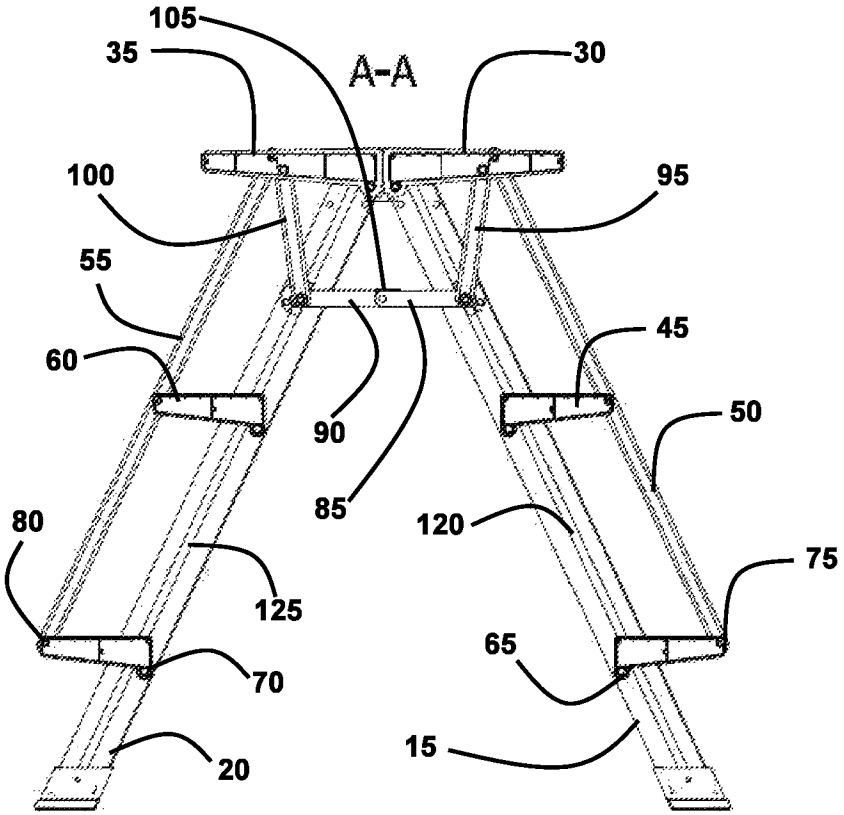
FIG. 3 is the ladder shown as viewed from the section A-A.

FIG. 3 is the ladder 10 shown as viewed from the section A-A of FIG. 2. The ladder 10 has a pair of right siderails 15 rotatably connected to a pair of left siderails 20. The ladder 10 also has a plurality of right steps 45. Each of the right steps 45 has a right rail-joining point 75 so that each right rail-joining point 75 is rotatably attached to a right linking rail 50. Similarly, the ladder 10 also has a plurality of left steps 60. Each of the left steps 60 has a left rail-joining point 80 so that each left rail-joining point 80 is rotatably attached to a left linking rail 55.

The right linking rail 50 is rotatably connected to the right top-cap 30 and the left linking rail 55 is rotatably connected to the left top-cap 35.

Each right step 45 has one or more right rail-joining points 75 so that each right step 45 is rotatably attached to the right linking rail 50 at the corresponding right rail-joining point 75 and each left step 60 has a left rail-joining point 80 wherein each left step 60 is rotatably attached to the left linking rail 55 at the corresponding left rail-joining point 80.

The right linking rail 50 of the ladder 10 is also connected to the right top cap 30 and the left linking rail 55 of the ladder 10 is also connected to the left top cap 35. The right top cap 30 and the left top cap 35 may be used to support weight of a user or an item place on the right top cap 30 or the left top cap 35, or both, and the right top cap 30 and the left top cap 35 are rotatably connected to each other.

The ladder 10 may also have a right spreader 85 and a left spreader 90. Each of the right spreader 85 and the left spreader 90 has two ends. One end of the right spreader 85 is rotatably attached to the right siderail 15 and the other end of the right spreader 85 is attached to the left spreader 90. Similarly, one end of the left spreader 90 is rotatably attached to the left siderail 20 and the other end of the left spreader 90 is attached to the right spreader 85.

To better secure the ladder 10 when the ladder is in erected open position, the ladder 10 also has a right support bar 95 and a left support bar 100. Each of the right support bar 95 and the left support bar 100 has two ends. One end of the right support bar 95 is rotatably attached to the right siderail 15 and the other end is attached to the right top cap 30. Likewise, one end of the left support bar 100 is rotatably attached to the left siderail 20 and the other end is attached to the left top cap 35.

The ladder 10 may be securely held open and erected better by having a spreader lock 105. The spreader lock 105 may be placed on either of the right spreader 85 or the left spreader 90, so that the spreader lock 105 prevents the right spreader 85 and the left spreader 90 from rotating beyond the horizontal position in one direction when the right spreader 85 and the left spreader 90 are horizontally aligned.

Figure 4:
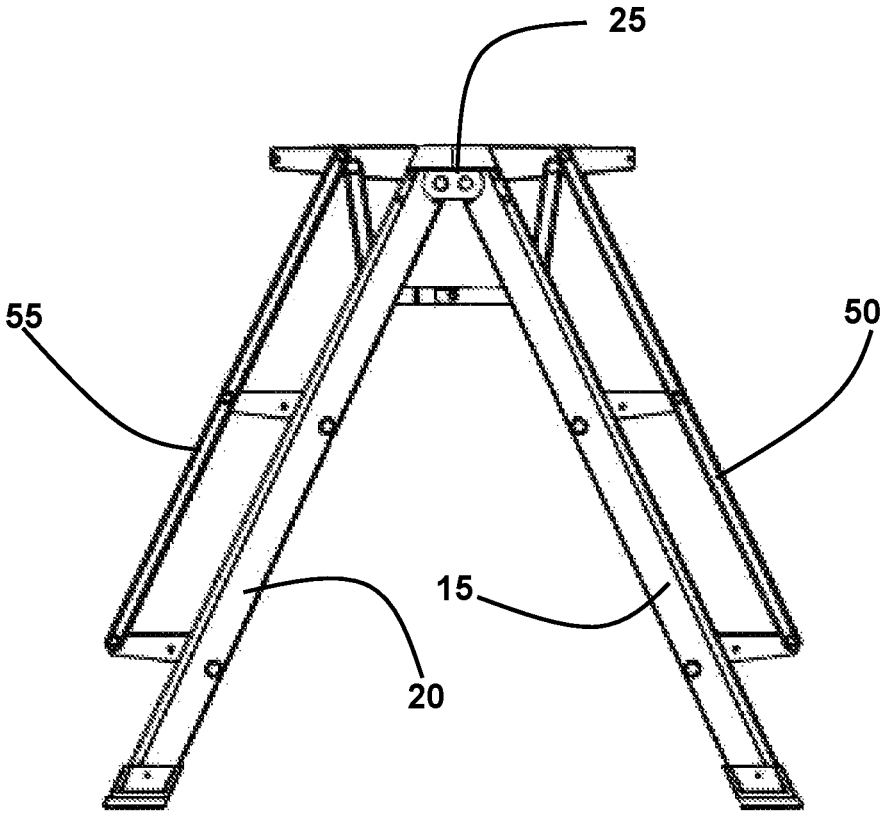
FIG. 4 is an embodiment of the ladder in open position.
Figure 5:
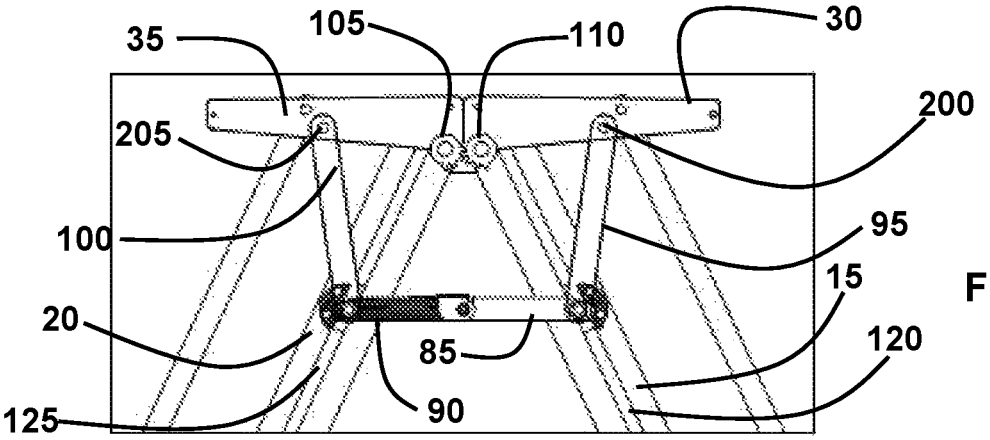
FIG. 5 is the ladder at the open position.

FIG. 4 is an embodiment of the ladder 10 in open position, a view from the rear-side of the ladder 10. The hinge plates 25 is shown in between the right siderail 15 and the left siderail 20 rotatably connecting the two.

Figure 6:
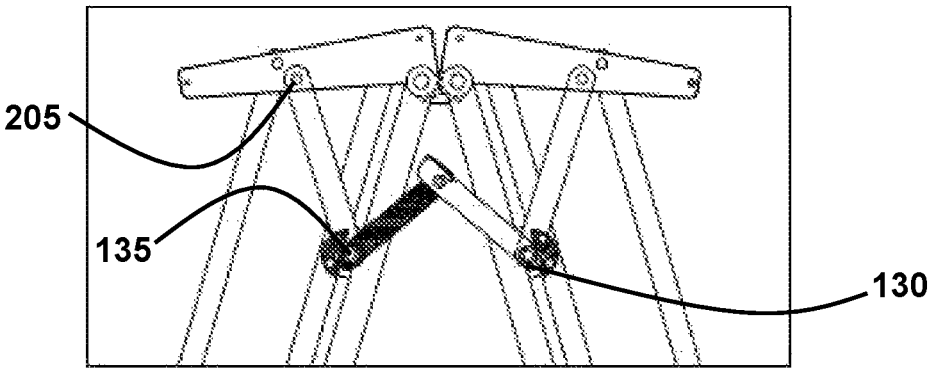
FIG. 6 is the ladder starting to fold.
Figure 7:
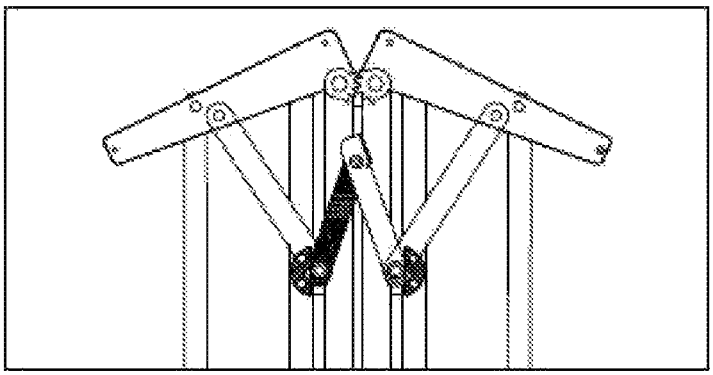
FIG. 7 is the ladder in a transition from the open position to the folded (collapsed) position.
Figure 8:
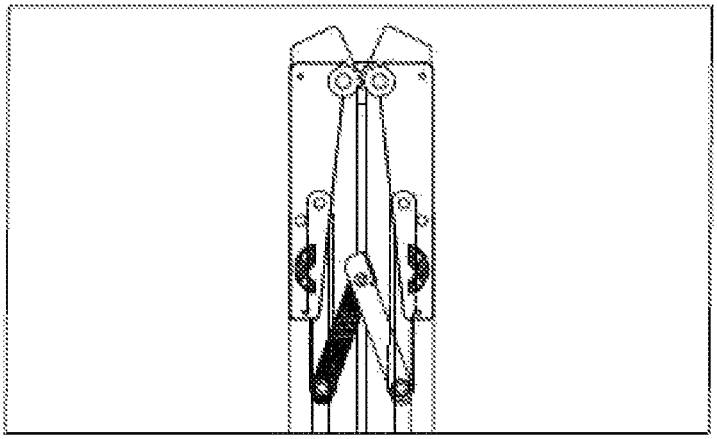
FIG. 8 is the ladder in fully folded (collapsed) position.
Figure 9:
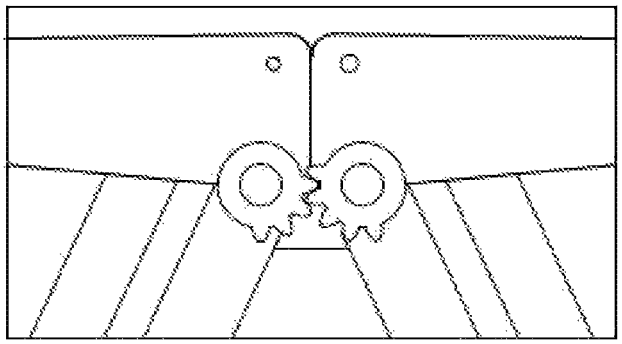
FIG. 9 is the ladder at the open position, showing the gears.
Figure 10:
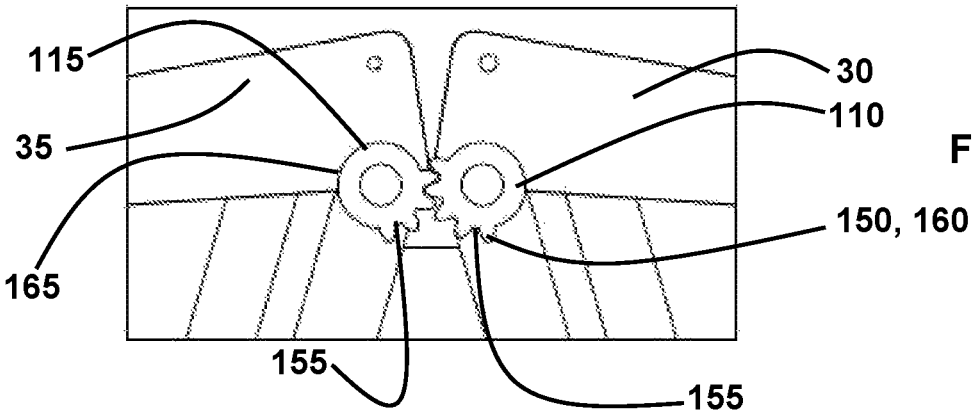
FIG. 10 is the ladder starting to fold, showing the gears.
Figure 11:
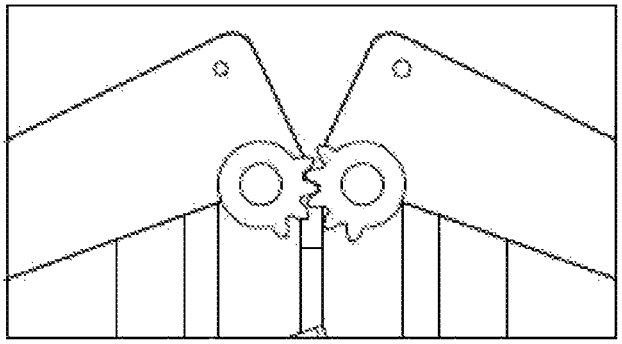
FIG. 11 is the ladder in a transition from the open position to the folded (collapsed) position, showing the gears.
Figure 12:
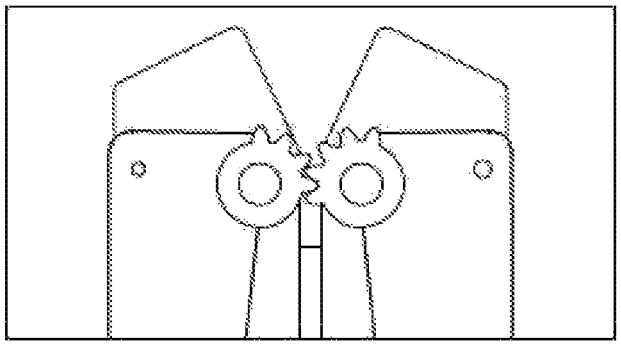
FIG. 12 is the ladder in fully folded (collapsed) position, showing the gears.

FIGS. 5-8 show the ladder 10 transitioning from the open erected position to the folded (or collapsed) position. FIG. 6 is the ladder 10 starting to fold, FIG. 7 is the ladder 10 in a transition from the open position to the folded (collapsed) position, and FIG. 8 is the ladder 10 in fully folded (collapsed) position. As shown, from the open position of the ladder 10, once the joint between the right spreader 85 and the left spreader 90 is pushed upward, the right top cap 30 and the left top cap 35 are rotated downward hinged by the right gear 110 and the left gear 105.

To better facilitate the folding the ladder 10, at least one of the siderails 15, 20 has a groove 120, 125 so that the support bar 95, 100 and the spreader 85, 90 joined together may slidably move along the groove 120. The sliding action may be accomplished by the right support bar 95 and the right spreader 85 joined together at a right slider point that is slidably attached to the right siderail 15 so that the right slider point 130 may slide along a right groove 120. Moreover, the sliding action may be accomplished by the left support bar 100 and the left spreader 90 joined together at a left slider point 135 that is slidably attached to the left siderail 20 so that the left slider point 135 may slide along a left groove 125. It is preferable that a groove 120 is on each of the pair of the right siderails 15 and a groove 125 is on each of the pair of the left siderails 20, so that each groove 120, 125 slidably receives a respective slider point 130, 135 formed by a support bar 95, 100 and a spreader 85, 90.

Figure 19:
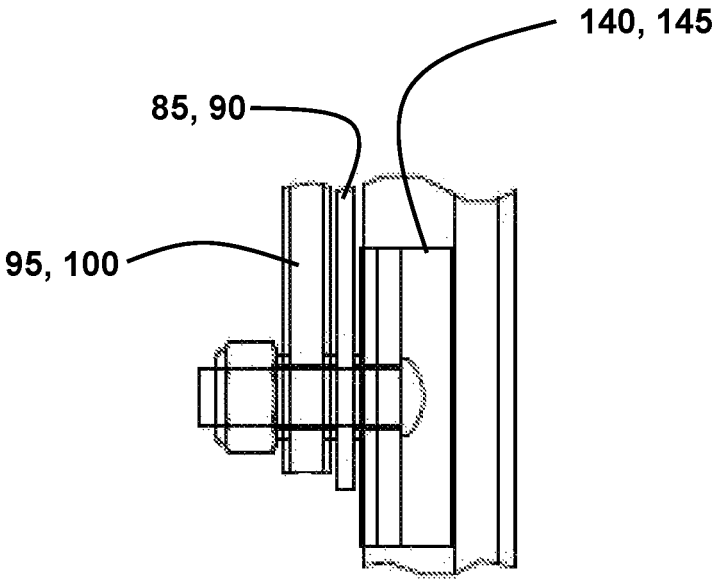
FIG. 19 is a slider block.

One or more of the right slider point 130 and the left slider point 135 may be a part of a larger slider block 140, 145 (see FIG. 19). For example, the right slider point 130 may be a part of a right slider block 140 that is slidably attached to the right siderail 15 so that the right slider block 140 may slide along the right groove 120. Likewise, the left slider point 135 is a part of a left slider block 145 that is slidably attached to the left siderail 20 so that the left slider block 145 may slide along the left groove 125. The use of a slider block 140, 145 prevents unnecessary wear and tear on the slider points 130, 135 and also facilitate more secure and tight fitting slide action along the grooves 120, 125.

As shown, from the open position of the ladder 10, once the joint between the right spreader 85 and the left spreader 90 is pushed upward, the right top cap 30 and the left top cap 35 are rotated downward hinged by the right gear 110 and the left gear 105. As the right top cap 30 and the left top cap 35 are rotated downward, the right and left slider blocks 140, 145 to move along the grooves of the right and left siderails 15, 20, collapsing the ladder 10 to save space for storage or hanging.

FIGS. 9-12 show the ladder 10 transitioning from the open erected position to the folded (or collapsed) position, showing the use of gears 110, 115. As shown, the right top cap 30 may also have a right gear 110 and the left top cap 35 may have a left gear 115. The right gear 110 has protrusions 150 and indentations 155 forming gear teeth 160 and the left gear 115 has protrusions 150 and indentations 155 forming gear teeth 160, so that the right gear 110 and the left gear 115 engage each other to rotate the right top cap 30 and the left top cap 35 at the same rate of rotation. The protrusions 150 and the indentations 155 of the right gear 110 and the left gear 115 do not have to be completely surrounding the outer rims 165 of the right gear 110 or the left gear 115 so that the rotation of the right gear 110 and the left gear 115 may be prevented at one or more predetermined positions.

Figure 13:
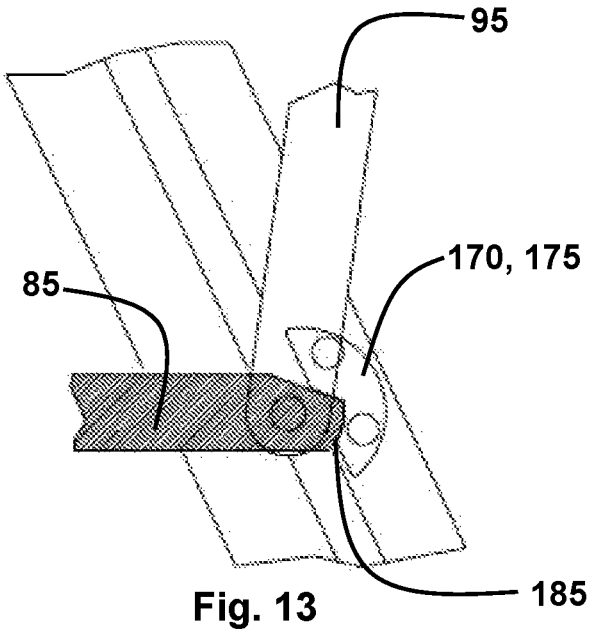
FIG. 13 is the ladder at the open position, showing a combination of the right spreader and the right support bar engaging the right spreader block.

FIGS. 13-16 show the ladder 10 transitioning from the open erected position to the folded (or collapsed) position, showing the use of spreader blocks 170, 175 (170 is a right spreader block and 175 is a left spreader block; left spreader block callout 175 is shown on FIG. 13 as reference). As shown, a combination of the right spreader 85 and the right support bar 95 engaging the right spreader block 170, stopped by the spreader block 170 due to the spreader block 170 having a spreader-block-indentation 180 (180 is a right spreader-block indentation and 190 is a left spreader-block indentation; left spreader-block indentation callout 190 is shown on FIG. 13 as reference) wherein the right spreader-block-indentation 180 receives a right-end portion 185 of the right spreader 85 assisting to secure the ladder from accidentally folding or collapsing.

Figure 14:
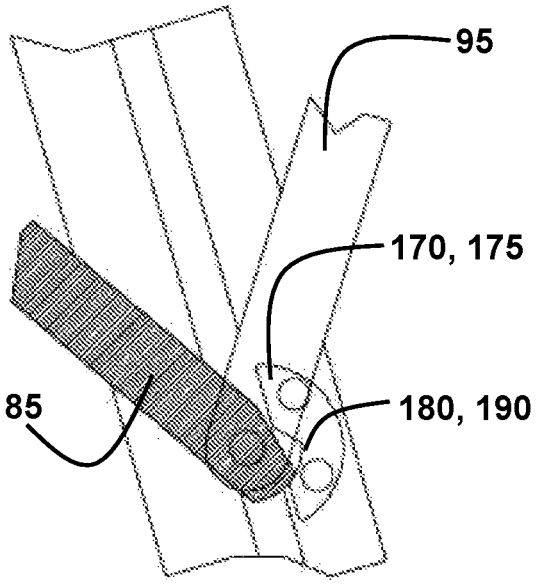
FIG. 14 is the ladder starting to fold, showing the combination of the right spreader and the right support bar starting to disengaging the right spreader block.
Figure 15:
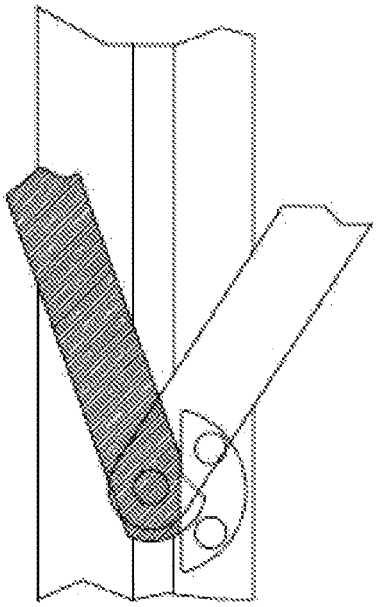
FIG. 15 is the ladder in a transition from the open position to the folded (collapsed) position, showing the combination of the right spreader and the right support bar disengaging the right spreader block.
Figure 16:
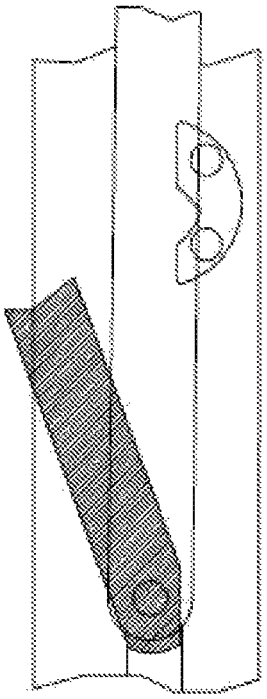
FIG. 16 is the ladder in fully folded (collapsed) position, showing a combination of the right spreader and the right support bar having disengaged the right spreader block.

FIG. 14 shows the ladder 10 starting to fold, showing the combination of the right spreader 85 and the right support bar 95 starting to disengaging the right spreader block 170. FIG. 15 shows the ladder 10 in a transition from the open position to the folded (collapsed) position, showing the combination of the right spreader 85 and the right support bar 95 disengaging the right spreader block 170. FIG. 16 shows the ladder 10 in fully folded (collapsed) position, showing a combination of the right spreader 85 and the right support bar 95 fully disengaged the right spreader block 170. Although not shown (they are mirror images of the FIGS. 13-16), the left side of the combination of the left spreader 90 and the left support bar 100 engaging the left spreader block 175, stopping the left spreader block 175 due to the left spreader-block-indentation 190 wherein the left spreader-block-indentation 190 receives a left-end portion 195 of the left spreader 90, assisting to secure the ladder from accidentally folding or collapsing.

Figure 17:
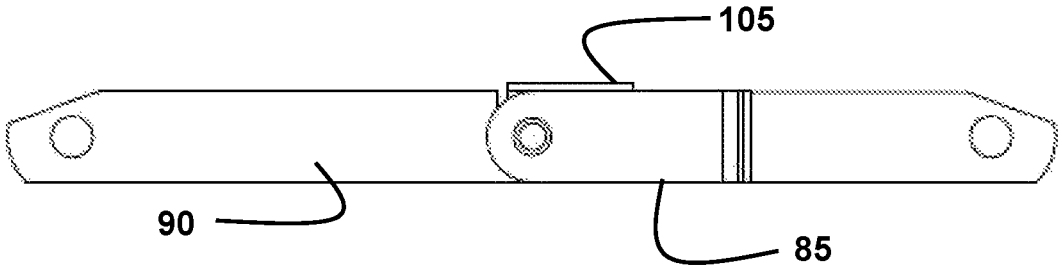
FIG. 17 is a combination of the right spreader and the left spreader having a spreader lock.

FIG. 17 shows a combination of the right spreader 85 and the left spreader 90 having a spreader lock 105. Although FIG. 17 shows the spreader lock 105 is on the right spreader 85, it is just as practical to have the spreader lock 105 is on the left spreader 90.

Figure 18:
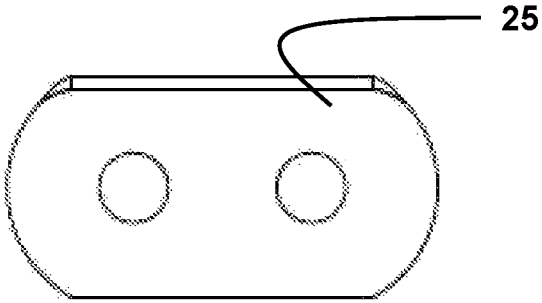
FIG. 18 is a hinge plate.

FIG. 18 shows a hinge plate 25. Referring to FIG. 1, the right top cap 30 and a left top cap 35 are rotatably attached to the hinge plate 25. Also, one of the right siderail 15 and one of the left siderail 20 are also rotatably attached to the hinge plate 25.

FIG. 19 shows a slider block 140, 145. One or more of the right slider point 130 and the left slider point 135 may be a part of a larger slider block 140, 145. For example, the right slider point 130 may be a part of a right slider block 140 that is slidably attached to the right siderail 15 so that the right slider block 140 may slide along the right groove 120. Likewise, the left slider point 135 is a part of a left slider block 145 that is slidably attached to the left siderail 20 so that the left slider block 145 may slide along the left groove 125. The use of a slider block 140, 145 prevents unnecessary wear and tear on the slider points 130, 135 and also facilitate more secure and tight fitting slide action along the grooves 120, 125.

Figure 20:
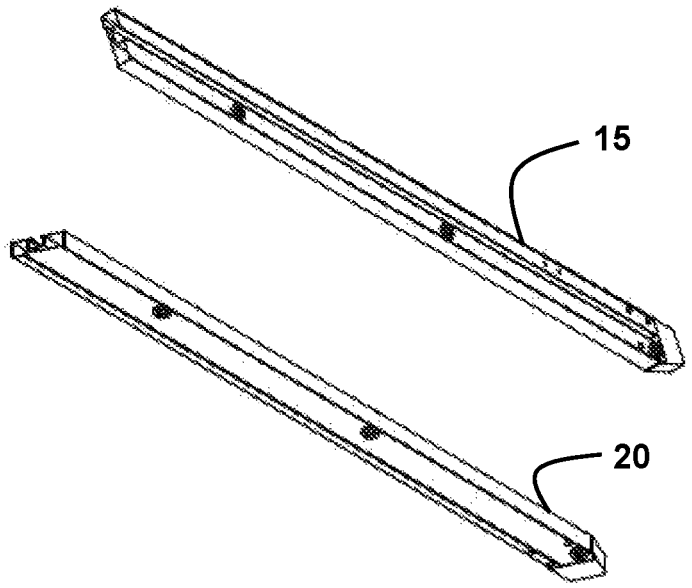
FIG. 20 is a right siderail and a left siderail, each with its groove.

FIG. 20 shows one of the right siderails 15 and one of the left siderails 20, each with its groove 120, 125.

Figure 21:
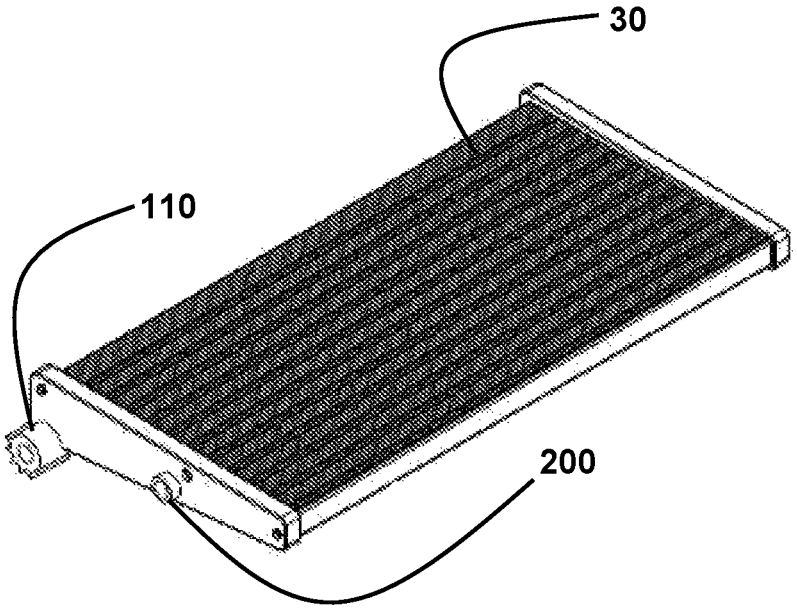
FIG. 21 is a right top cap.

FIG. 21 shows the right top cap 30. AS shown, the right top cap 30 has a non-slip surface. The non-slip surface may be a rubber pad, a plastic pad, a knurled surface or any other non-slip surfaces used in a ladder or steps. The right top cap has a right gear 110 to rotatably engage a left gear 115 (shown in FIGS. 3, 5-8). As shown in FIGS. 5-8, one end of the right support bar 95 attached to the right top cap 30 at a right support node 200 (also shown in FIG. 5) on the right top cap 30. Also, as shown in FIGS. 5-8, one end of the left support bar 100 attached to the left top cap 35 at a left support node 205 (shown in FIGS. 5-6) on the left top cap 35.

Figure 22:
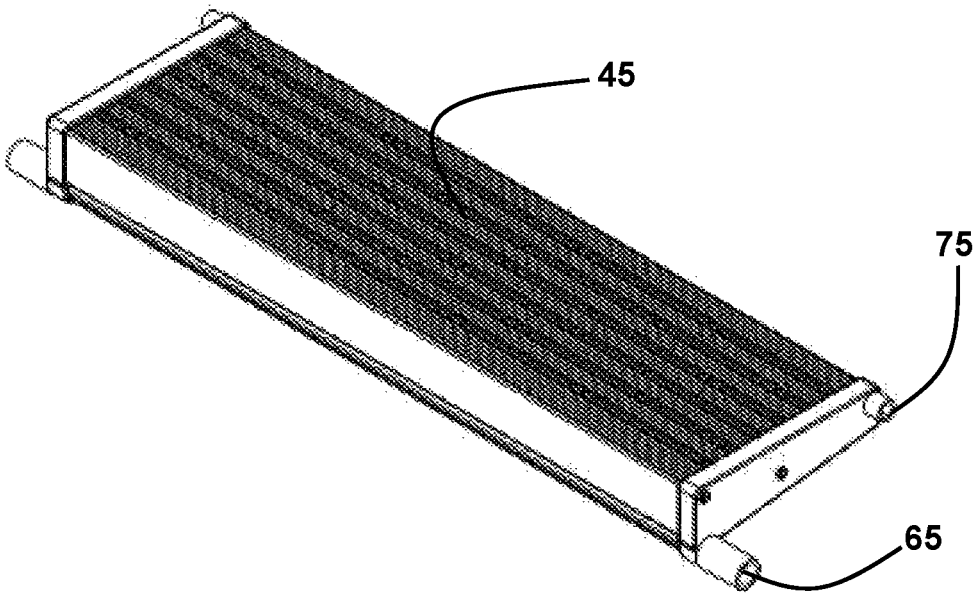
FIG. 22 is a right step.

FIG. 22 shows one of the right steps 45. As shown in FIG. 3, each of the right steps 45 has a right rail-joining point 75 where one of the right linking rails 50 is rotatably attached, and has a right step-joining point 65 where one of the right siderails 15 is rotatably attached. FIG. 3 also shows each of the left steps 60 has a left rail-joining point 80 where one of the left linking rails 55 is rotatably attached, and has a left step-joining point 70 where one of the left siderails 20 is rotatably attached.

Figure 23:
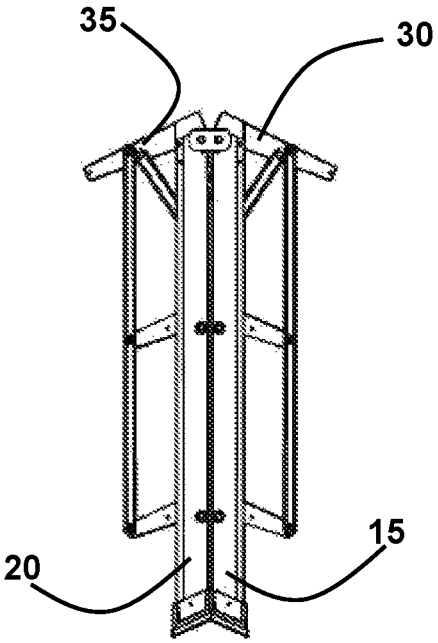
FIG. 23 is the ladder in a near folded (collapsed) position, the right siderail and the left siderails are together but the steps are not yet folded (collapsed)
Figure 24:
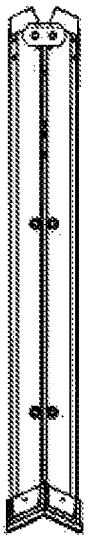
FIG. 24 is the ladder in a fully folded position.
Figure 25:
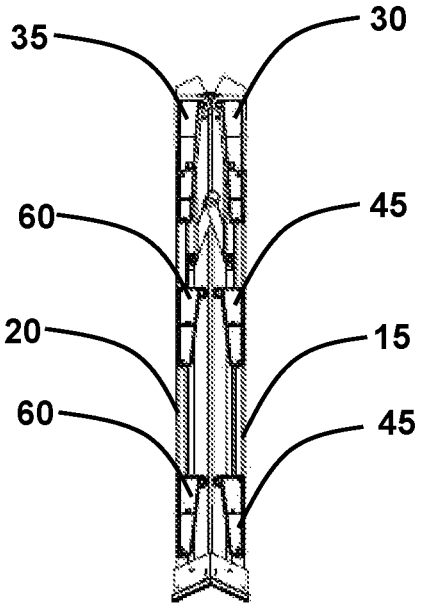
FIG. 25 is a cut-away view of FIG. 24 showing the internal structure of the folded ladder.

FIG. 23 shows the ladder 10 in a near folded (collapsed) position, wherein the right siderail 15 and the left siderails 20 are together but the right steps 45 and the left steps 60 are not yet folded (collapsed). FIG. 24 shows the ladder 10 in a fully folded position and FIG. 25 shows a cut-away view looking into FIG. 24 showing the internal structure of the folded ladder 10, such all of the steps 45, 60 are also folded (collapsed).

While various embodiments have been shown and described, it will be appreciated by those skilled in the art that variations in form, detail, compositions and operation may be made without departing from the spirit and scope of the invention. Thus, the specification and the embodiments presented herein do not limit the scope of the invention, but only illustrate the best mode at the time of this application and possible potentials of the invention. Therefore, the claims presented shall be interpreted to the full scope afforded by law.

What is claimed is:

1. A ladder comprising, a pair of right siderails rotatably connected to a pair of left siderails;

a plurality of right steps wherein each right step has a right rail-joining point rotatably attached to a right linking rail;

a plurality of left steps wherein each left step has a left rail-joining point rotatably attached to a left linking rail;

the right linking rail rotatably connected to a right top-cap and the left linking rail rotatably connected to a left top-cap;

the plurality of right steps wherein each right step further comprises of a right step-joining point wherein each right step is rotatably attached to the right siderail at the right step-joining point;

the plurality of left steps wherein each left step further comprises of a left step-joining point wherein each left step is rotatably attached to the left siderail at the left step-joining point;

the right top cap and the left top cap are rotatably connected to each other; and the pair of the right siderails are rotatably attached to the right top cap and the pair of the left siderails are rotatably attached to the left top cap.

2. The ladder of claim 1 further comprising, a right spreader having two ends wherein one end is rotatably attached to the right siderail and the other end is attached to a left spreader, and the left spreader having two ends wherein one end is rotatably attached to the left siderail and the other end is attached to a right spreader.

3. The ladder of claim 2 further comprising, a right support bar having two ends wherein one end is rotatably attached to the right siderail and the other end is attached to the right top cap, and a left support bar having two ends wherein one end is rotatably attached to the left siderail and the other end is attached to the left top cap.

4. The ladder of claim 3 wherein a hinge plate rotatably connects one of the pair of right siderails and one of the pair of left siderails.

5. The ladder of claim 4 wherein either of the right spreader or the left spreader has a spreader lock wherein the spreader lock prevents the right spreader and the left spreader from rotating further in one direction when the right spreader and the left spreader are horizontally aligned.

6. The ladder of claim 5 wherein the right top cap has a right gear and the left top cap has a left gear, wherein the right gear and the left gear engage each other to rotate the right top cap and the left top cap at the same rate of rotation.

7. The ladder of claim 6 wherein at least one of the right siderails has a right groove, and wherein the right support bar and the right spreader are joined together by a right slider point that is slidably attached to the right siderail so that the right slider point may slide along the right groove.

8. The ladder of claim 7 wherein at least one of the left siderails has a left groove, and wherein the left support bar and the left spreader are joined together by a left slider point that is slidably attached to the left siderail so that the left slider point may slide along the left groove.

9. The ladder of claim 8 further comprising a right spreader block mounted on at least one of the right siderails wherein the right spreader block has a right spreader-block-indentation wherein the right spreader-block-indentation receives a right-end portion of the right spreader.

10. The ladder of claim 9 further comprising a left spreader block mounted on at least one of the left siderails wherein the left spreader block has a left spreader-block-indentation wherein the left spreader-block-indentation receives a left-end portion of the left spreader.

11. The ladder of claim 10 further comprising an anti-slip foot at one end of the each of the right siderails and the left siderails.

12. The ladder of claim 11 wherein the right slider point is a part of a right slider block that is slidably attached to the right siderail so that the right slider block may slide along the right groove.

13. The ladder of claim 12 wherein the left slider point is a part of a left slider block that is slidably attached to the left siderail so that the left slider block may slide along the left groove.

14. A ladder comprising, a pair of right siderails are rotatably connected to a pair of left siderails;

a plurality of right steps wherein each right step has a pair of right rail-joining points wherein each right rail-joining point is rotatably attached to one of a pair of right linking rail;

a plurality of left steps wherein each left step has a pair of left rail-joining points wherein each left rail-joining point is rotatably attached to one of a pair of left linking rail;

the pair of right linking rails rotatably connected to a right top-cap and the pair of left linking rails rotatably connected to a left top-cap;

the plurality of right steps wherein each right step further comprises of a pair of right step-joining points wherein each right step is rotatably attached to the pair of right siderails at the corresponding right step-joining points;

the plurality of left steps wherein each left step further comprises of a pair of left step-joining points wherein each left step is rotatably attached to the pair of left siderails at the corresponding left step-joining points;

the right top cap and the left top cap are rotatably connected to each other;

the pair of the right siderails are rotatably attached to the right top cap and the pair of the left siderails are rotatably attached to the left top cap; and the right top cap has a right gear and the left top cap has a left gear wherein the right gear and the left gear engage each other, wherein the right gear has a plurality of protrusions and a plurality of indentations forming gear teeth and the left gear has a plurality of protrusions and a plurality of indentations forming gear teeth, so that the right gear and the left gear engage each other to rotate the right top cap and the left top cap at the same rate of rotation.

15. The ladder of claim 14 further comprising, a pair of right spreaders wherein each of the right spreader has two ends wherein one end is rotatably attached to one of the right siderails and the other end is attached to one of a pair of left spreaders, and each of the pair of left spreaders has two ends wherein one end is rotatably attached to one of the left siderails and the other end is attached to one of the pair of right spreaders.

16. The ladder of claim 15 further comprising, a pair of right support bars wherein each of the right support bars has two ends, wherein one end is rotatably attached to one of the right siderails and the other end is rotatably attached to the right top cap, and a pair of left support bars, wherein each of the left support bars has two ends wherein one end is rotatably attached to one of the left siderails and the other end is rotatably attached to the left top cap.

17. The ladder of claim 16 wherein a hinge plate rotatably connects one of the pair of right siderails and one of the pair of left siderails.

18. The ladder of claim 17 wherein either of the right spreader or the left spreader connected to each other has a spreader lock wherein the spreader lock prevents the connected right spreader and the connected left spreader from rotating further in one direction when the connected right spreader and the connected left spreader are horizontally aligned.

19. The ladder of claim 18 wherein the protrusions and the indentations of the right gear and the protrusions and the indentations of the left gear do not completely surrounding the outer rims of the right gear and the left gear so that the rotation of the right gear and the left gear may be prevented at one or more predetermined positions.

20. The ladder of claim 19 wherein at least one of the right siderails has a right groove, and wherein the right support bar and the right spreader are joined together by a right slider point that is slidably attached to the right siderail so that the right slider point may slide along the right groove, wherein at least one of the left siderails has a left groove, and wherein the left support bar and the left spreader are joined together by a left slider point that is slidably attached to the left siderail so that the left slider point may slide along the left groove, and wherein the left slider point is a part of a left slider block that is slidably attached to the left siderail so that the left slider block may slide along the left groove and the right slider point is a part of a right slider block that is slidably attached to the right siderail so that the right slider block may slide along the right groove.

* * * * *